US010230174B2

(12) United States Patent
Wang

(10) Patent No.: US 10,230,174 B2
(45) Date of Patent: Mar. 12, 2019

(54) FREQUENCY DIVERSE PHASED-ARRAY ANTENNA

(71) Applicant: Yan Wang, Pasadena, CA (US)

(72) Inventor: Yan Wang, Pasadena, CA (US)

( * ) Notice: Subject to any disclaimer, the term of this patent is extended or adjusted under 35 U.S.C. 154(b) by 169 days.

(21) Appl. No.: 15/239,347

(22) Filed: Aug. 17, 2016

(65) Prior Publication Data

US 2018/0054006 A1 Feb. 22, 2018

(51) Int. Cl.

| | |
|---|---|
| ***H01Q 21/24*** | (2006.01) |
| ***H01Q 1/48*** | (2006.01) |
| ***H01Q 9/04*** | (2006.01) |
| ***H01Q 21/06*** | (2006.01) |
| ***H01Q 21/00*** | (2006.01) |
| ***H01Q 3/30*** | (2006.01) |

(52) U.S. Cl.

CPC ..... *H01Q 21/24* (2013.01); *H01Q 1/48* (2013.01); *H01Q 3/30* (2013.01); *H01Q 9/0428* (2013.01); *H01Q 21/0087* (2013.01); *H01Q 21/065* (2013.01)

(58) Field of Classification Search

CPC ..... H01Q 9/0407; H01Q 21/24; H01Q 21/28; H01Q 1/48; H01Q 3/30; H01Q 9/0428; H01Q 21/0087; H01Q 21/065

See application file for complete search history.

(56) References Cited

U.S. PATENT DOCUMENTS

| | | | | |
|---|---|---|---|---|
| 5,933,121 | A * | 8/1999 | Rainhart | G01R 3/00 324/127 |
| 6,184,832 | B1 * | 2/2001 | Geyh | H01Q 21/0087 343/700 MS |
| 9,755,306 | B1 * | 9/2017 | Ogilvie | H01Q 3/30 |
| 2005/0063447 | A1 * | 3/2005 | Ammar | G01K 11/006 374/1 |
| 2014/0070999 | A1 * | 3/2014 | Kaneda | H01L 24/14 343/700 MS |
| 2016/0172755 | A1 * | 6/2016 | Chen | H01Q 1/523 342/371 |
| 2016/0197404 | A1 * | 7/2016 | Hashimoto | H01Q 9/0435 343/848 |
| 2016/0211585 | A1 * | 7/2016 | Chau | H01Q 9/285 |
| 2016/0233178 | A1 * | 8/2016 | Lamy | H01Q 1/2283 |
| 2017/0093041 | A1 * | 3/2017 | McMichael | H01Q 9/0435 |

(Continued)

*Primary Examiner* — Dameon E Levi
*Assistant Examiner* — Ab Salam Alkassim, Jr.
(74) *Attorney, Agent, or Firm* — PATENTRY; Peter G. H. Hwang

(57) ABSTRACT

A frequency diverse phased-array antenna operates simultaneously in two bands. A checkerboard of antenna elements for a first wavelength is offset with a second checkerboard of second antenna elements. Within the substrate is a three dimensional checkerboard of ground planes and ground walls which provide signal isolation between the bands. Multiple ground planes optimize operation at the several frequencies. Phased-array elements are isolated by a conductive wall in a multi-layer substrate. Orthogonal polarization of antenna patches further improve signal discrimination. Below the surface layer, another conductive wall isolates each quadrature hybrid. The conductive wall can be realized by metal vias or metal mesh infused through a dielectric and surrounding a raised ground plane to isolate electrical fields at each frequency. A conductive wall also provides quadrature hybrid isolation.

2 Claims, 21 Drawing Sheets

(56) References Cited

U.S. PATENT DOCUMENTS

| | | | | |
|---|---|---|---|---|
| 2017/0093042 | A1* | 3/2017 | McMichael | H01Q 9/0428 |
| 2017/0352960 | A1* | 12/2017 | Zhang | H01Q 9/0464 |
| 2018/0277956 | A1* | 9/2018 | Zhang | H01Q 21/065 |

* cited by examiner

| Θ (Scanning Angle Range, deg) | Maximum Element spacing d |
|---|---|
| +/-10 | .85λ |
| +/-20 | .75λ |
| +/-30 | .67λ |
| +/-40 | .61λ |
| +/-50 | .57λ |
| +/-60 | .54λ |
| +/-70 | .54λ |
| +/-80 | .5λ |
| +/-90 | .5λ |

FIG. 5

FREQUENCY DIVERSE PHASED-ARRAY ANTENNA

CROSS-REFERENCES TO RELATED APPLICATIONS

None

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Technical Field

An article of manufacture by printed circuit board technique combining dielectric layers infused with conductive vias and interleaved with conductive films to provide a phased-array antenna tuned for a plurality of wavelengths.

Background

A conventional phased-array antenna enables a highly directive antenna beam to be steered toward a single certain direction. The direction of an antenna beam may be controlled by setting the phase shifts of each of the antenna elements in the array. As is known, conventional phased-array antennae provide directed beams by setting gain and phase shift for each of a plurality of antenna elements.

Printed Circuit Board (PCB) technology is also used to produce multilayer hybrid integrated circuits, which can include resistors, inductors, capacitors, and active components in the same package. There are a number of similar low loss RF and high frequency substrates such as Rogers, Teflon, and Megtron 6, which are suitable for multilayer construction. As is well known, conventional manufacturing processes are referred to as printed wire board, printed circuit board, low temperature co-fired ceramics, hybrid devices, and multi-layer packaging. These include the steps of etching, lithography, drilling, plating, sputtering, diffusing, depositing, coating, screening, washing, spraying, and bonding as non-limiting examples of placing conductors through and on dielectric materials. In this application we may refer to these methods as infusing.

As is known, a planar phased-array antenna consists of a number of antenna elements, deployed on a planar surface. Incoming planar waveforms arrive at different antenna elements of a receive phased-array antenna at different delays. These delays are conventionally compensated with phase shifts before the signals are combined. Conversely, a transmit array consists of a number of antenna elements on a planar surface, and the signals for these elements are phase shifted before they are transmitted to compensate for signal delay toward a certain direction.

FIG. 1 illustrates conventional phased array embodiments. The well-known phased-array antenna operating principle are related:

Array pattern=Element Gain Array Factor(good approximation for scanning angle of interest)$F$(cos.alpha.$xs$,cos.alpha.$ys$)=$m$=0$M$−1$n$=0$N$−1$Amnej$[$m$2.$pi$..lamda.$dx$(cos.alpha.$x$−cos.alpha.$xs$)+$n$2.$pi$..lamda.$dy$(cos.alpha.$y$−cos.alpha.$ys$)] ##EQU0001##

It is desirable to have a smooth element pattern which covers the array field of view (FoV). FIG. 2 illustrates the results of combining signals for angles of interest using a conventional circuit such as FIG. 3. For a planar phased-array antenna with antenna elements deployed with regular spacing in a grid, the spacing between adjacent elements must be less than a certain value, determined by its scanning angle, to prevent grating lobe. FIG. 4 illustrates the two terms of element spacing and maximum scanning angle. FIG. 5 is a table of desired scanning angle range in degrees and the maximum element spacing in wavelengths.

Furthermore, the dimension of the antennas on a substrate may be optimized by the thickness of the substrate which would be desirably proportional to the wavelength or the inverse of the operating frequency.

Suppose a first antenna is designed to operate at a certain frequency. In order to preserve the same antenna properties (matching, bandwidth, gain, . . . ) at a second antenna for a second frequency, all relative dimensions of the second antenna design must be approximately inversely proportional to its second frequency. Based on the above discussion, if a planar antenna is designed on a substrate, the thickness of the substrate should be approximately proportional to the inverse of operating frequency. For two side-by-side antenna elements (e.g. two patch antennas), one for each frequency, the substrate thickness would preferably be different as shown in the diagram of FIG. 6.

However, to generate a smooth antenna pattern with a wide beamwidth, it is necessary to have large enough ground plane—typically, ground plane size>.lamda..times..lamda.. Note that it is difficult, especially for antenna 2, to have sufficient size ground plane due to limited available aperture. It is also difficult to obtain good isolation since the two antenna elements are separated by sub-wavelength distance. What is needed is more compact and economical frequency diversity in phased-array antennas with minimized occurrence of grating lobes.

SUMMARY OF THE INVENTION

A frequency diverse phased-array antenna operates simultaneously in two bands. A checkerboard of antenna elements for a first wavelength is offset with a second checkerboard of second antenna elements. Within the substrate is a three dimensional checkerboard of ground planes and ground walls which provide signal isolation between the bands. Multiple ground planes optimize operation at the several frequencies. Phased-array elements are isolated by a conductive wall in a multi-layer substrate. Orthogonal polarization of antenna patches further improve signal discrimination.

Below the surface layer, another conductive wall isolates each quadrature hybrid. The conductive wall can be realized by metal vias or metal mesh passing through a dielectric and surrounding a raised ground plane to isolate electrical fields at each frequency. A conductive wall also provides quadrature hybrid isolation.

A multi-frequency planar phased-array antenna is disclosed. A plurality of conductive walls (typically realized by a plurality of conductive vias with small spacing) coupled to a first ground plane isolates electromagnetic fields of a first array of antenna patches from electromagnetic fields of a second array of antenna patches. A second ground plane optimizes the performance of the second array of antenna patches.

A planar antenna with multiple ground planes is provided to optimize operation at more than one frequency. The ground plane separation below each antenna patch is chosen to optimize its intended operating wavelength.

The first patch elements are isolated by a conductive wall in a multi-layer substrate. The conductive wall effectively sets the size of the ground plane below the first patch, which influences its radiation properties.

Orthogonal polarization of antenna patches further improves signal discrimination. Below the surface layer, another conductive wall isolates each quadrature hybrid technology used to realize orthogonal polarization.

One embodiment of the invention is a method to fabricate a single planar antenna of phased-array elements optimized to operate at more than one frequency out of layers of dielectric substrates.

A multi-layer substrate has ground planes suitable for at least a first frequency and a second frequency.

Metal walls (e.g. approximated with a plurality of metal vias, or metal mesh in the metal layer or stacked layers within a multilayer structure) passing through a dielectric surround a raised ground plane to isolate electrical fields of each frequency.

Quadrature hybrid isolation is provided by a metal wall (e.g. approximated with a plurality of metal vias or mesh). The polarization of the transmit element and the receive element are independent and each can be circular, elliptical and linear.

The present invention includes a plurality of separate antenna element structures on the same aperture, one for each frequency. The present disclosure enables the placement of at least two separate antennas in the same aperture while maintaining small separation. The plurality of vias or mesh effectively approximates a metal wall which defines the size of the elevated ground plane. This makes the resultant antenna element pattern smooth. The metal wall shields the fringing fields of one antenna from any other, thus providing very good isolation.

The present invention provides a method to fabricate a single planar antenna of phased-array elements optimized to operate at more than one frequency. The fabrication of a multi-layer substrate enables ground planes suitable for a plurality of different frequencies. The substrate may be ceramic substrate or organic substrate.

The antenna system supports simultaneous dual polarization i.e. linear, elliptical, and circular polarization directed beams. The system simultaneously supports two orthogonally polarized beams.

A control circuit loads gain and phase settings for each antenna element. In combination, the antenna elements drive a beam direction and polarization of any type and alignment.

BRIEF DESCRIPTION OF FIGURES

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 5 is a table of spacing and scanning angles;

DETAILED DISCLOSURE OF EMBODIMENTS

Figure 1:
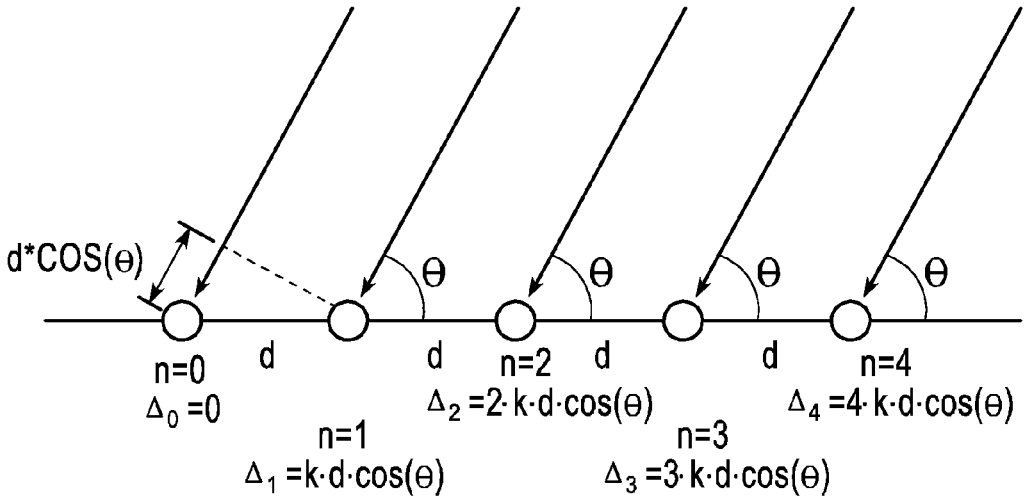
FIG. 1 is an idealized side view showing directed signal beam incident on antenna array elements at an angle.
Figure 2:
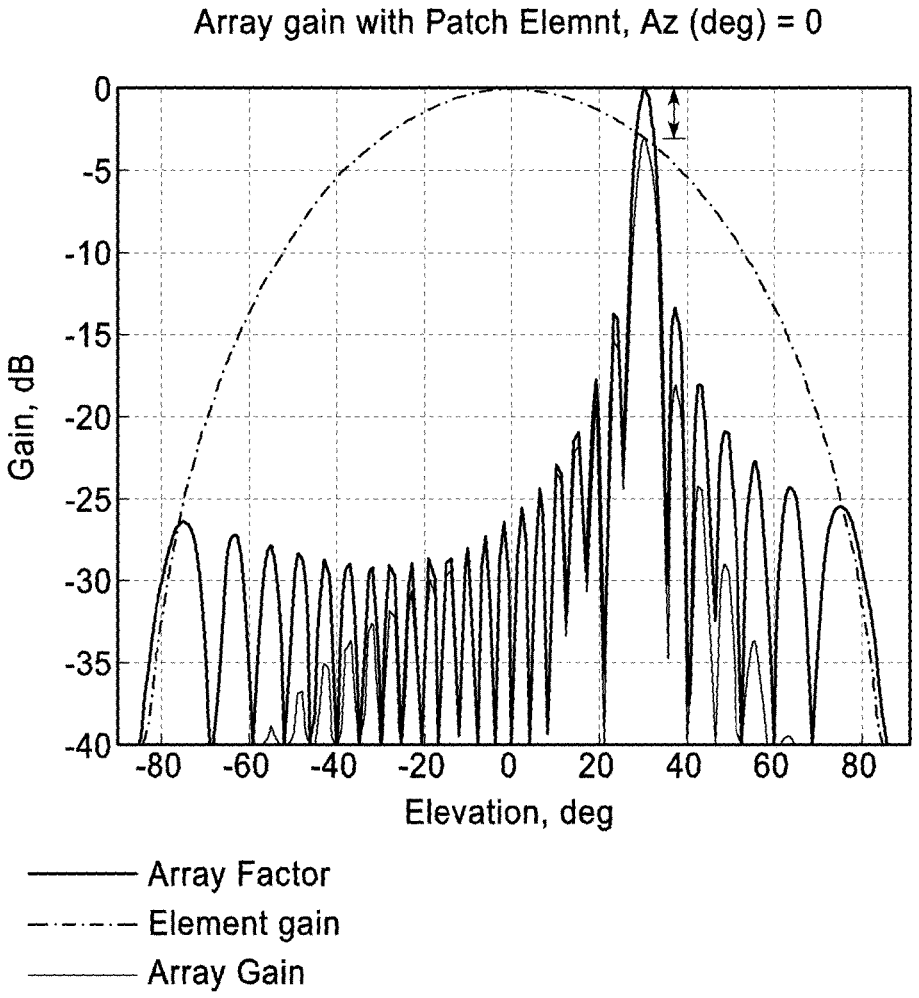
FIG. 2 is a graph of antenna array gain by beam elevation.
Figure 3:
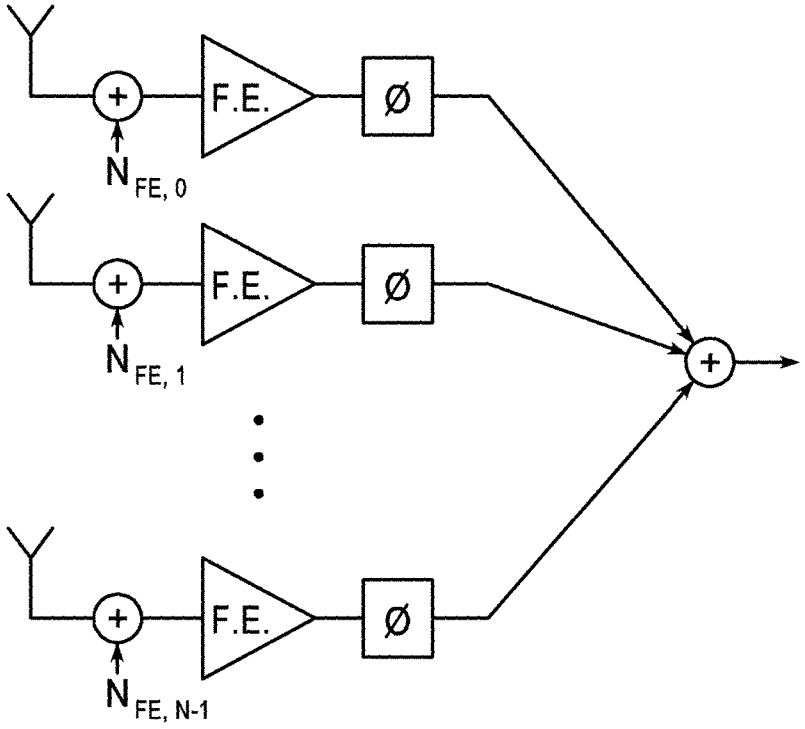
FIG. 3 is a conventional circuit schematic of a phased-array antenna.
Figure 4:
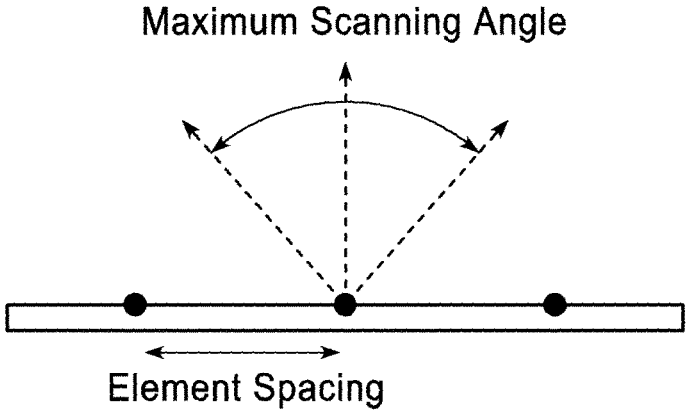
FIG. 4 is an illustration defining element spacing and maximum scanning angle.
Figure 6:
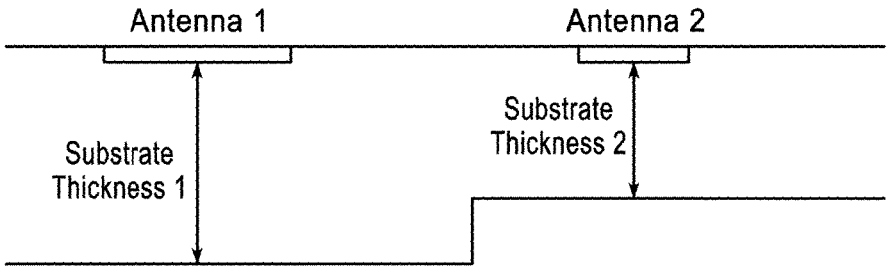
FIG. 6 is an idealized section of two antennas separated by substrate from their ground planes optimized for different operating frequencies.

A frequency diverse phased-array antenna is fabricated by printed circuit board techniques to operate simultaneously in two bands. A checkerboard of antenna elements for a first wavelength is offset with a second checkerboard of second antenna elements, both applied as films to a layer of dielectric substrate. Within the substrate is a three dimensional checkerboard of ground planes and ground walls coupled to each other which provide signal isolation between the bands. Conductive vias passing through the ground planes couple the antenna elements to phase shifters and variable gain amplifiers.

Multiple ground planes optimize operation at the several frequencies. Phased-array elements are isolated by a conductive wall in a multi-layer substrate. Orthogonal polarization of antenna patches further improve signal discrimination.

One embodiment of the invention is a stack of ceramic or organic dielectric substrates which have conductive film and filled holes.

A planar antenna array has multiple ground planes to optimize operation at more than one frequency.

Phased-array elements are isolated by a conductive wall (that can be approximated by a plurality of conductive vias) in a multi-layer substrate.

One aspect of the invention is an article of manufacture for a multiple band planar phased-array antenna system comprising a plurality of substrate strata: a delta strata includes a substrate of thickness proportional to a difference between a first wavelength of a first signal operating at a first frequency and a second wavelength of a second signal operating at a second frequency; a plurality of conductive walls isolating electromagnetic fields of a first signal from electromagnetic fields of a second frequency; a plurality of signal carrying leads of the first signal; a plurality of signal carrying leads of the second signal; and a film of radio frequency (rf) conductive material applied to an upper most surface of the substrate material orthogonal to the leads and conductive walls, partitioned to a plurality of areas above and coupled to each signal carrying lead and a plurality of areas bounded by each conductive wall with an opening surrounding the film above signal carrying leads of the first signal, wherein the conductive walls and the area bounded by the conductive walls are grounded with respect to the first signal.

In an embodiment the article of manufacture also has a topmost strata including a substrate of thickness proportional to a first wavelength of a first signal operating at a first frequency; a plurality of conductive walls embedded into the substrate isolating electromagnetic fields of a first signal from electromagnetic fields of a second frequency; a plurality of signal carrying leads of the first signal embedded into the substrate; a plurality of signal carrying leads of the second signal embedded into the substrate; and a film of radio frequency (rf) conductive material applied to an upper most surface of the substrate material orthogonal to the leads and conductive walls, partitioned to a plurality of antenna patches coupled to each signal carrying lead and a plurality of hollow areas above each conductive wall isolating the electromagnetic fields of the first signal from the electromagnetic fields of the second signal wherein the conductive walls and the hollow area above the conductive walls are grounded with respect to the first signal.

In an embodiment, the article of manufacture also has a base strata which includes substrate material intended to be separated from the antenna patches when assembled by a distance proportional to a second wavelength of a second signal operating at a second frequency; a plurality of conductive walls isolating electromagnetic fields of a first signal from electromagnetic fields of a second frequency; a plurality of signal carrying leads of the first signal; a plurality of signal carrying leads of the second signal; and a film of rf conductive material applied to an upper most surface of the substrate material orthogonal to the leads and conductive walls, partitioned to a plurality of areas above and coupled to each signal carrying lead and an area with perforations surrounding the film above each signal carrying lead, wherein the conductive walls and the perforated area are grounded with respect to the first signal and second signal.

In an embodiment, the hollow area is an annulus with inner radius substantially equal to but fractionally less than a diameter of a conductive wall.

In an embodiment, the area bounded by each conductive wall with an opening surrounding the film above signal carrying leads of the first signal is an annulus with inner radius substantially equal to but fractionally greater than the diameter of each signal carrying lead.

Orthogonal polarization of antenna patches further improve signal discrimination.

Below the surface layer, another metal wall isolates each quadrature hybrid.

One aspect of the invention is a dual-band phased-array which consists of a planar array of square patch antennas on either ceramic or organic substrate.

For each unit cell, two patches of different sizes are responsible for transmitting and receiving signals at different frequencies. The patches can be microstrip fed, probe (via) fed, or slot-coupled structures.

One patch (for higher frequency) is situated above a raised ground, which results in similar dielectric thickness in proportional to the electrical lengths for the patches. Metal wall (approximated by densely populated metallic vias or mesh) surround the raised ground, which helps to isolate the two patches.

Figure 7:
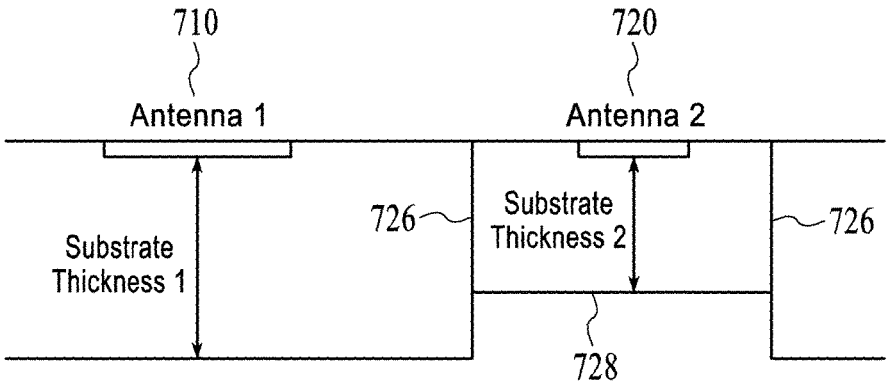
FIG. 7 is a side section of dual antennas isolated by their ground planes and a conductive wall.

Referring now to FIG. 7, one solution is to surround Antenna 2 720 with a conductive wall 726 which isolates from Antenna 1 710. A groundplane 728 is defined by the wall.

The unit cell employs stacked-up topology where multiple layers of dielectric materials are used.

A method to fabricate a single planar antenna of phased-array elements optimized to operate at more than one frequency includes relative placement of elements. To have minimum interaction between the two antennas in the same aperture, it is beneficial to place the two antennas in the diagonally opposite quadrants in order to obtain maximum separation.

Figure 8:
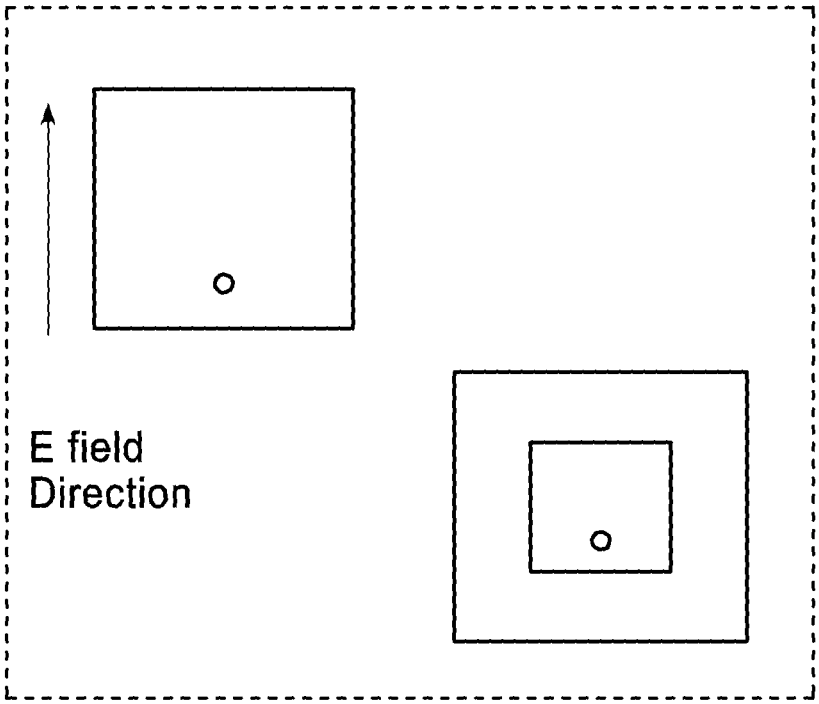
FIG. 8 is a top view of an offset pair of linear polarized antenna patches.

If a patch antenna is used, the E field direction is shown in the up-down direction. So that a preferred embodiment is to have the antennas in two quadrants having minimum interaction (catercorner) as shown in FIG. 8. Another preferred embodiment is to place the antennas in two abutting quadrants but with 90 degree offset in orientation.

A multi-layer substrate has ground planes suitable for different frequencies.

Figure 9A:
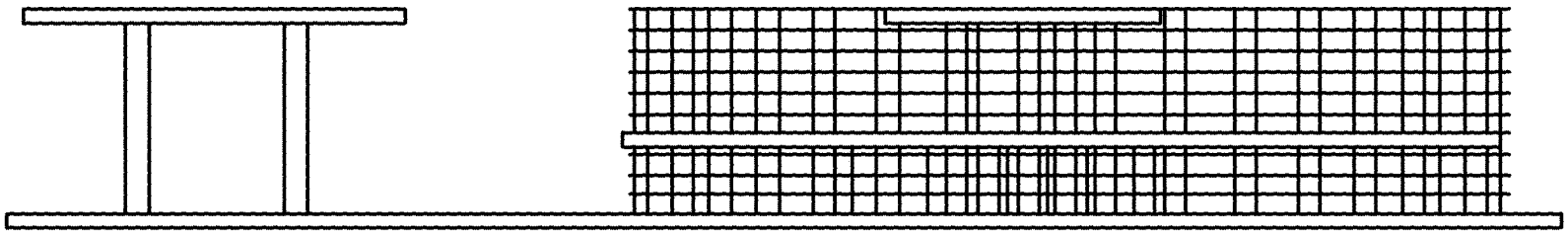
FIGS. 9A and 9B are a stacked and an unstacked side view showing conductive walls, probes, patches, and ground planes.
Figure 9B:
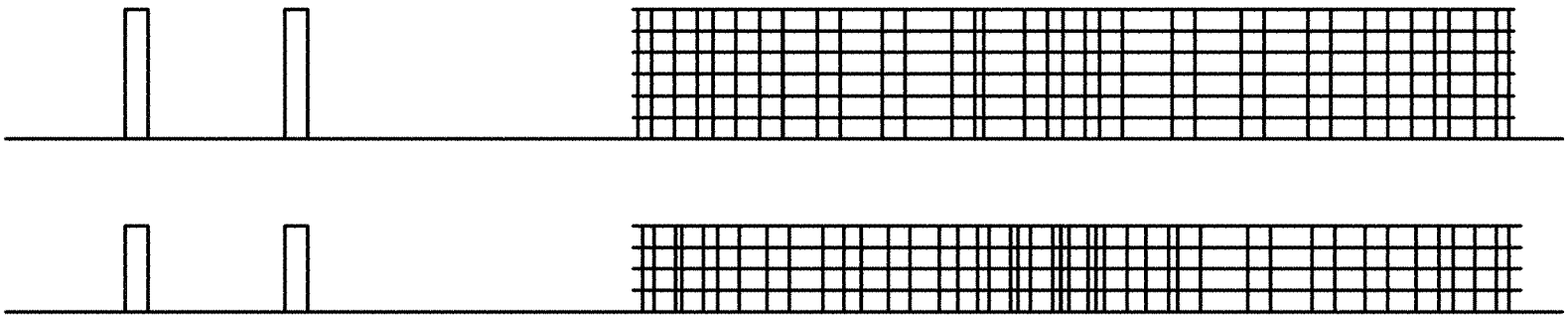

As shown in the side view of FIG. 9 A, the Receiver ground may be at a different level of substrate layers than the Transmitter ground. FIG. 9B shows the unstacked layers between which a ground plane having openings is inserted during conventional pcb fabrication steps. Signal carrying probes pass through the openings while conductive walls are coupled to at least one ground plane.

Figure 10:
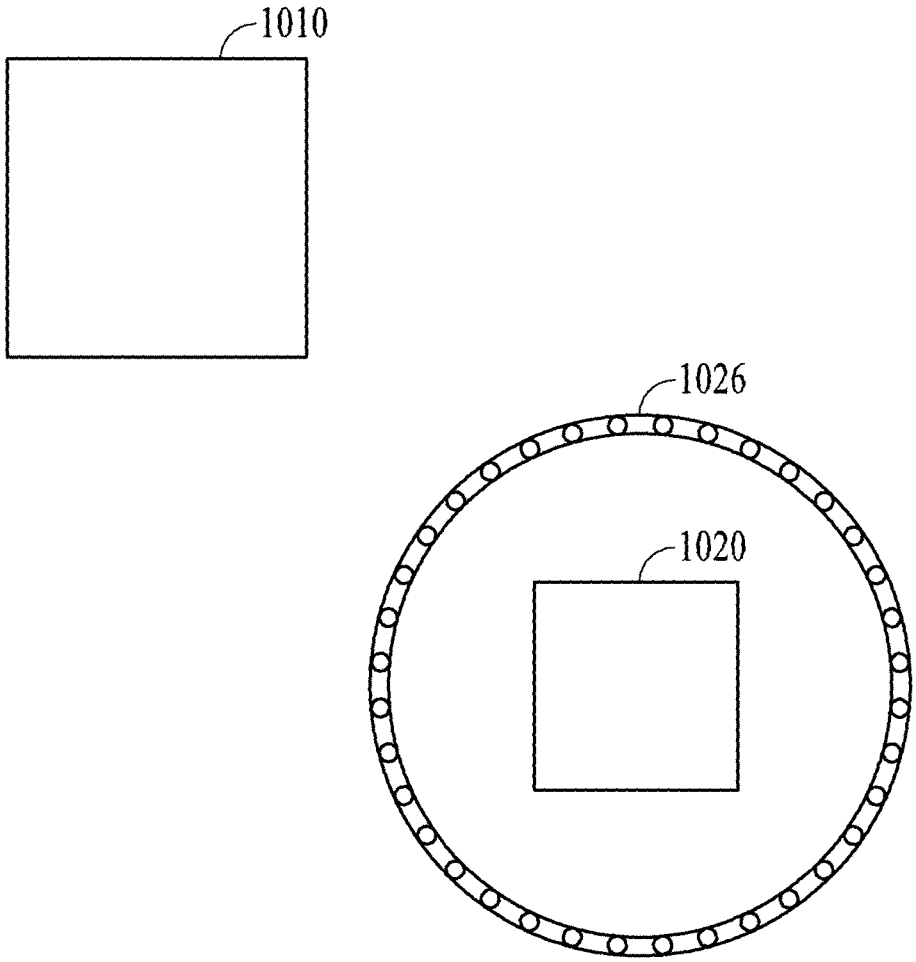
FIG. 10-11 are top views of conductive elements.

In an embodiment illustrated in FIG. 10 a top view of a phased-array element includes a receiver patch 1010, an antenna isolation conductive wall 1026, and within the antenna isolation conductive wall, a transmitter patch 1020.

Figure 11:
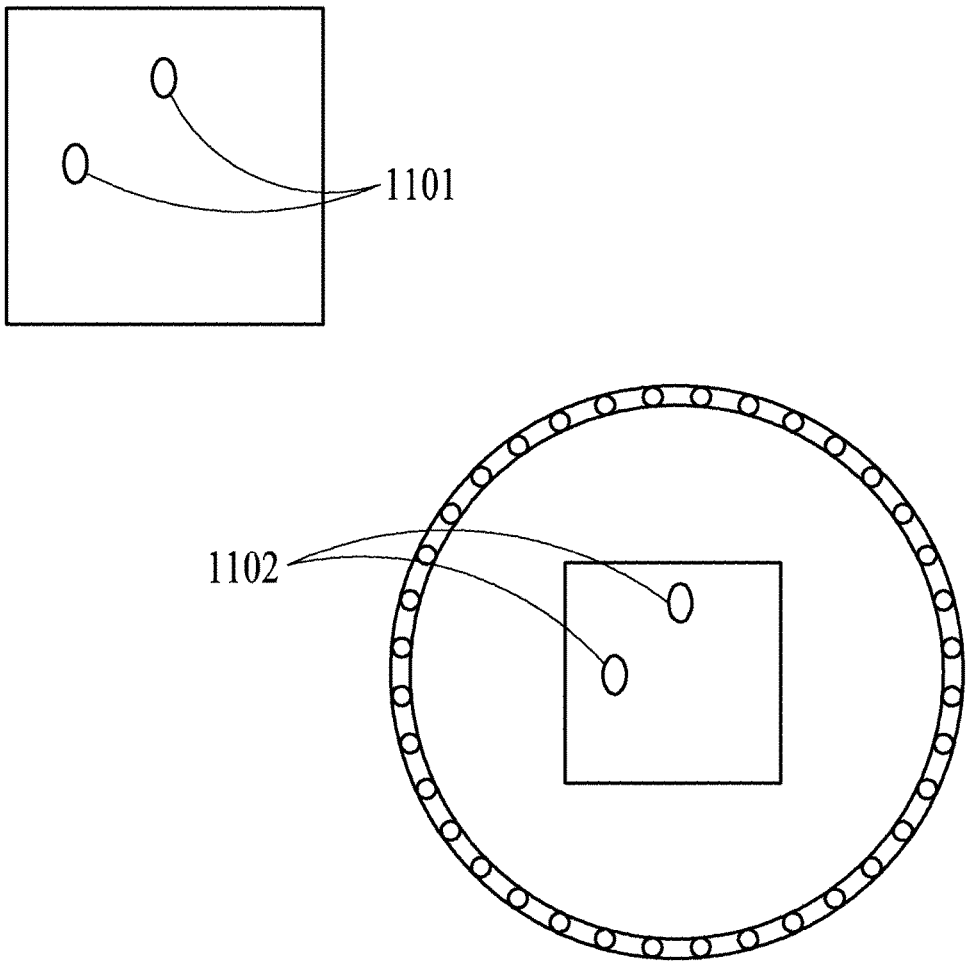

In an embodiment illustrated in FIG. 11 a top view of a dual frequency linear polarization phased-array element is shown further including two antenna probes for rx 1101 and tx 1102.

Figure 12A:
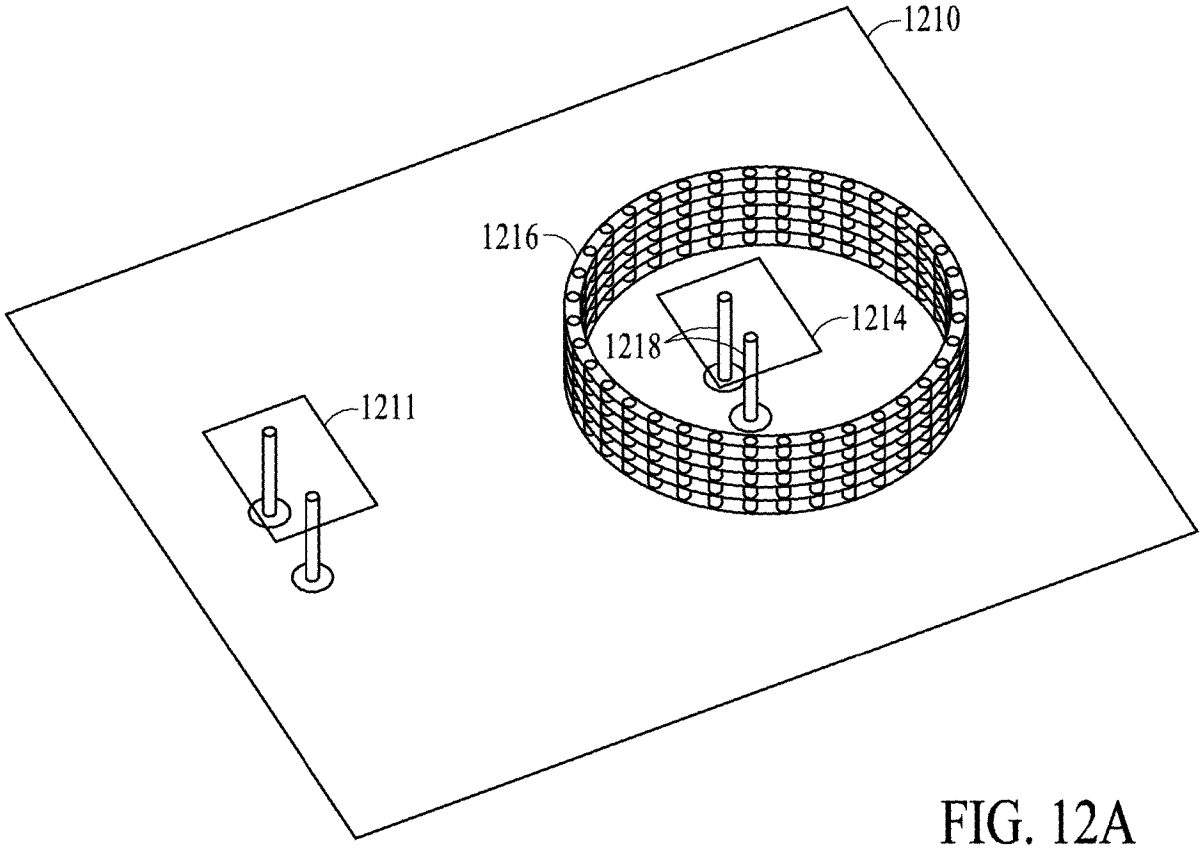
FIGS. 12A, 12B, and 13 are isometric projections of wireframe conductive elements.
Figure 12B:
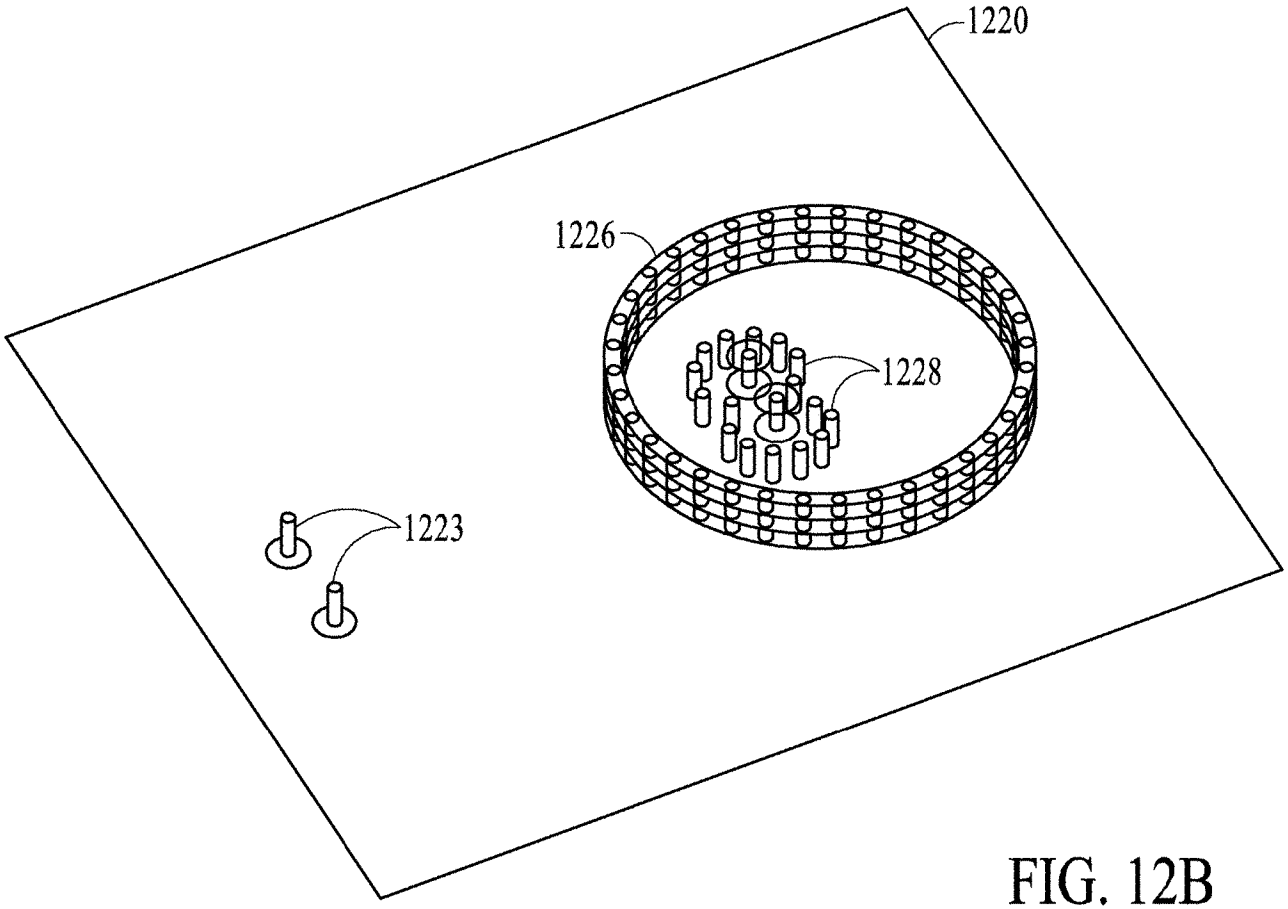

In an embodiment illustrated in FIGS. 12 A and B, a prestacked exploded isometric view of two layers provides a first layer 1210 having a receiver patch 1211 and a transmitter patch 1214. The transmitter patch is isolated by an antenna isolation via wall 1216 within which the two probes 1218 pass through a ground plane to provide dual frequency linear polarization for the transmitter patch. The second layer 1220 has the receiver patch ground, vias carrying the receiver signal 1223, and a continuation of the antenna isolation wall 1226. The conduction leads for the transmission signal are each coaxially shielded by other vias 1228.

Figure 13:
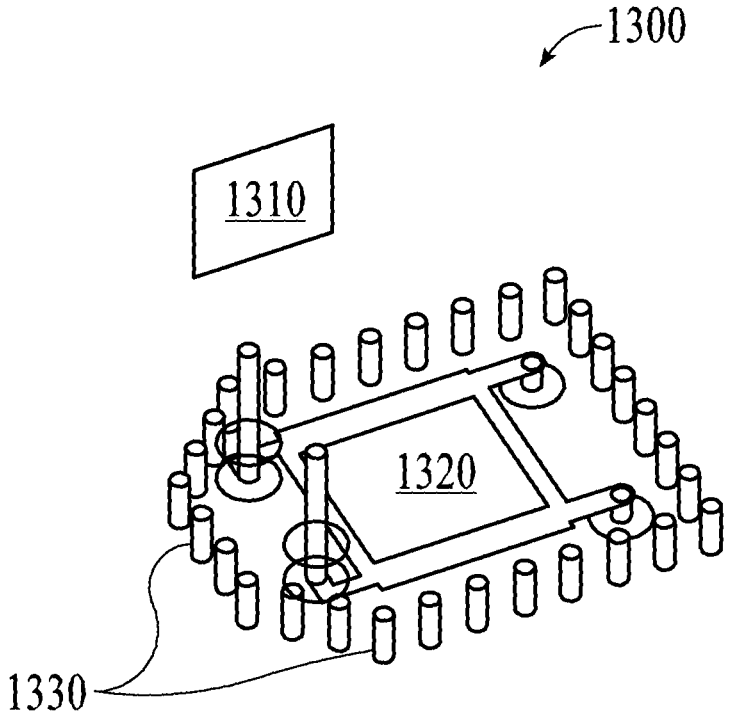

In an embodiment, quadrature hybrid technology isolation is provided by a conductive wall. An apparatus for generation of dual frequency circular polarization is illustrated in FIG. 13 an isometric view of an antenna element circuit 1300. A square patch 1310 is powered through a quadrature hybrid topology circuit. The hybrid circuit 1320 is shielded with a ground wall of vias 1330.

Figure 14A:
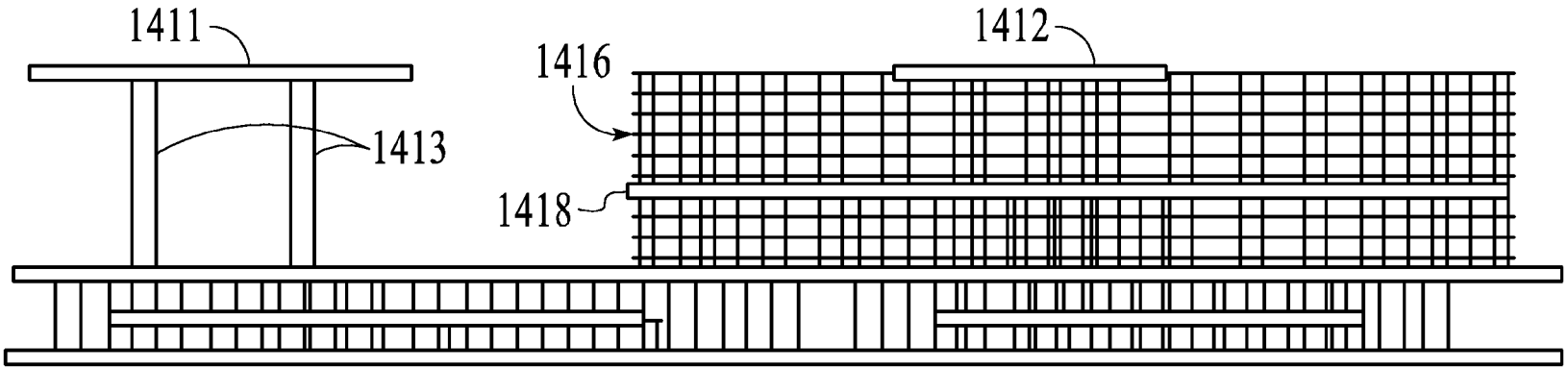
FIGS. 14A and 14B are a stacked and an unstacked side view showing conductive walls, probes, patches, and ground planes.
Figure 14B:
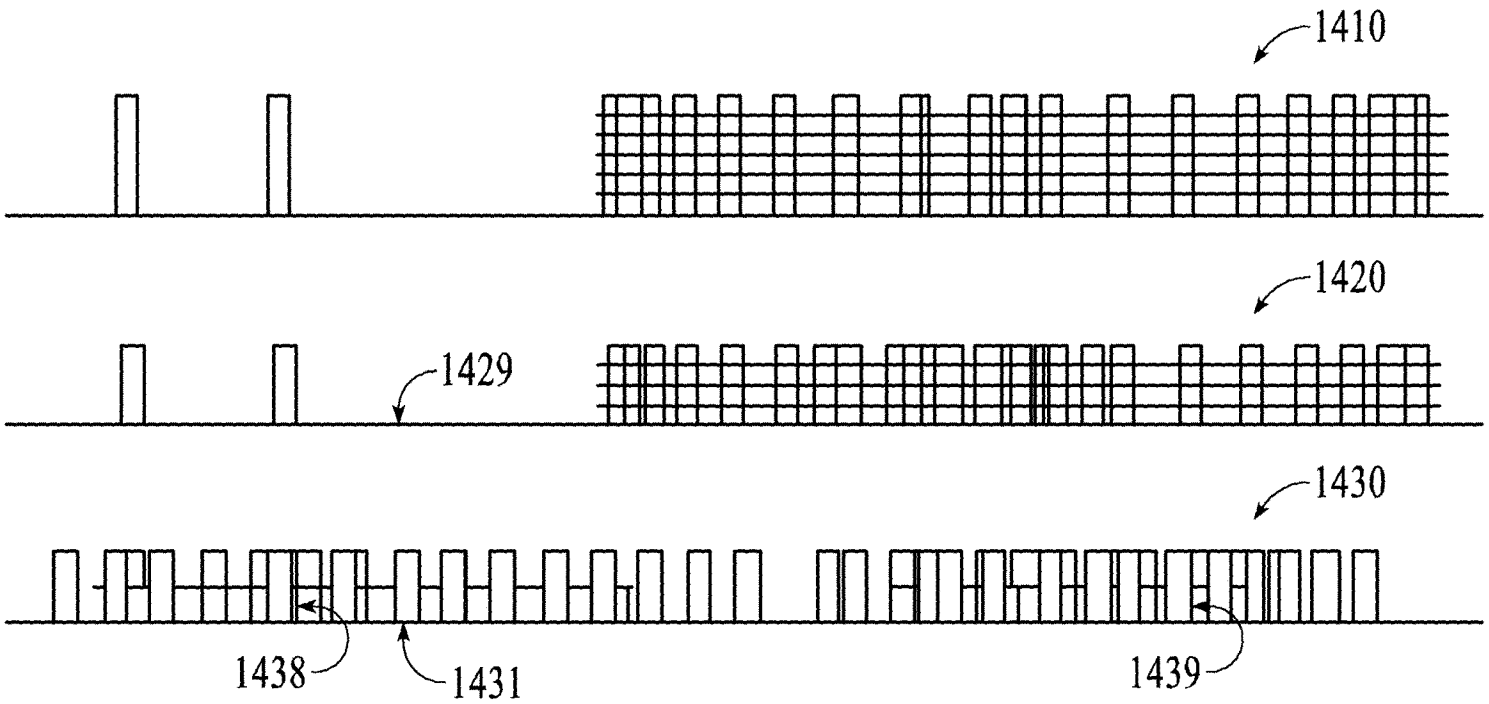

A method of fabrication of a circular polarization phased-array element is illustrated in the side view of layers in FIG. 14A and the stack of layers in FIG. 14B. A first layer 1410 has the receiver patch 1411 and the transmitter patch 1412 each powered through vias e.g. 1413 and isolated from one other by a wall of vias 1416 coupled to transmitter ground 1418. The second layer 1420 continues both the receiver via, the antenna isolation vias and the transmitter powered via coaxially shielded by other vias and the receiver ground/hybrid upper ground 1429. The third layer 1430 has the hybrid lower ground 1431, the receiver hybrid surrounded by isolation vias 1438 and the transmitter hybrid surrounded by isolation vias 1439.

Figure 15:
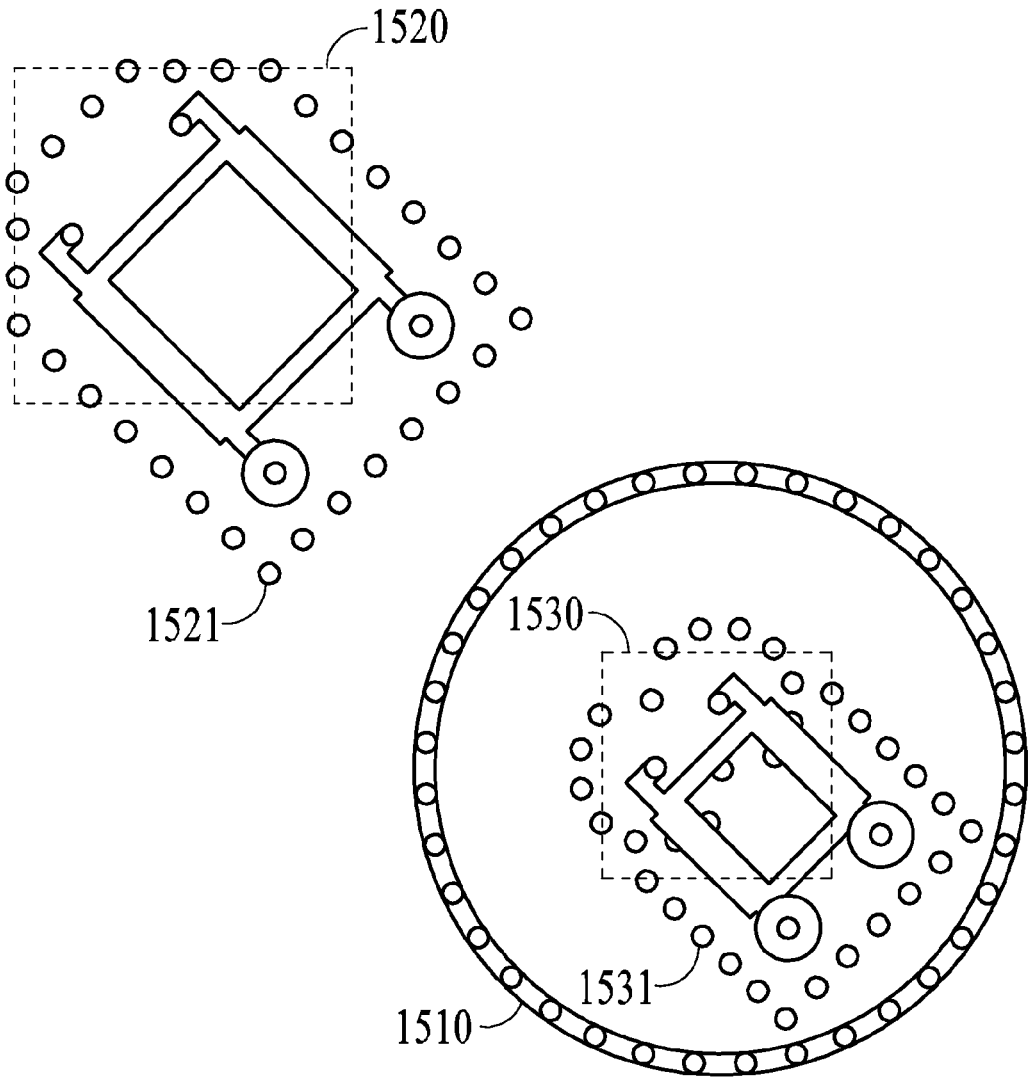
FIG. 15 is a transparent top view of conductive elements.

FIG. 15 shows a top view of an embodiment of phased-array elements which utilize circular polarization provided by a hybrid topology. A first via wall 1510 provides antenna isolation between the Receiver patch 1520 and the Transmitter patch 1530. A second via wall 1521 provides receiver hybrid isolation. A third via wall 1531 provides transmitter hybrid isolation.

Figure 16:
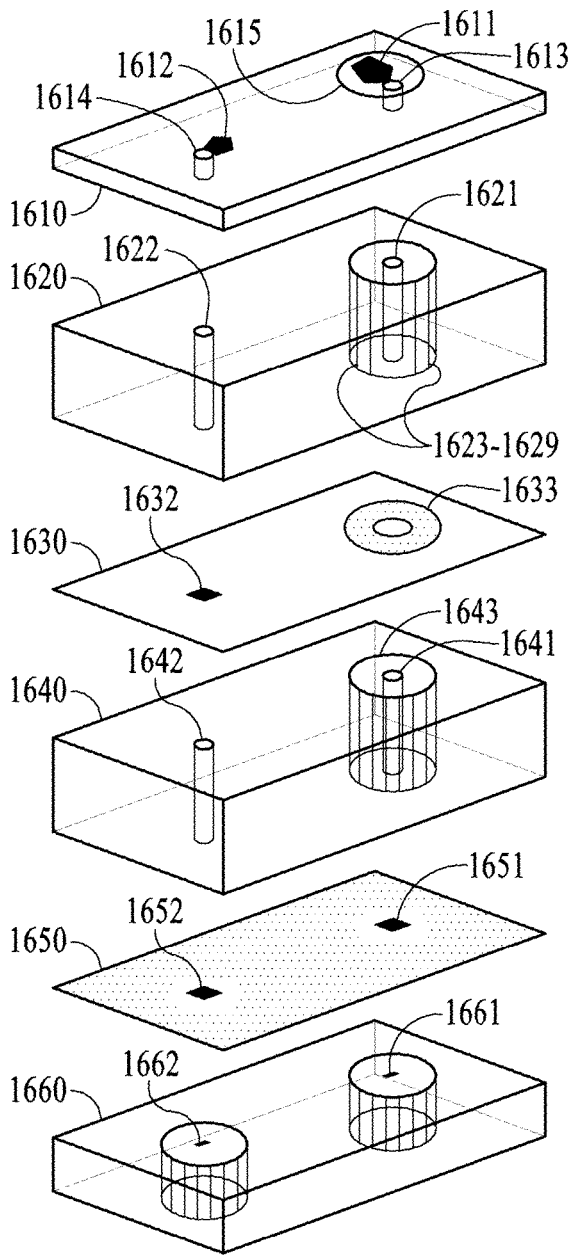
FIG. 16 is an exploded perspective view of layers.

FIG. 16 illustrates one or more aspects of the invention with embodiments. A top-most dielectric article of manufacture 1610 has conductive materials applied to and embedded within it. Antenna patches 1611 and 1612 are each coupled to probes/slots/vias/signal carriers 1613, 1614 that traverse through the dielectric. A conductive wall 1615 isolates the electromagnetic fields of the antenna patches from one another. In an embodiment the signal carriers are asymmetrically coupled to the antenna patches supporting orthogonal polarization of the radiated signals. I.e. Each is off centered in a way different from the other antenna patch. A second dielectric article of manufacture 1620 has conductive materials traversing through it to propagate signals from the top-most article to a first ground plane surface. Signal carriers 1621 1622 are isolated from one another by a conductive wall, in an embodiment a plurality of closely spaced vias 1623-1629 coupled to at least conductive wall 1615. A first ground plane surface 1630 includes conductive material formed as a ground plane 1633 coupled to the conductive wall with an opening and conductor (not shown) allowing further propagation of signal to signal carrier 1621. A void 1632 allows signal propagation for 1622 through surface 1630. A third dielectric article of manufacture 1640 includes conductive material embedded within it as signal carriers 1641-1642 and a continuation of the conductive wall 1643 to isolate the electromagnetic fields from one another. The thickness of the third dielectric article is related to the difference between the operating frequencies of the antenna patches. In an embodiment, the first ground plane surface 1630 may be a film applied to the second or third dielectric articles. A second ground plane surface 1650 includes conductive material having openings below each antenna patch. Within each opening is conductive material 1651, 1652 enabling further propagation of signals through the ground plane. In an embodiment, second ground plane surface 1650 may be a film applied to a dielectric article above or below it. Signal carrying material 1651 1652 can be any convenient shape as long as they don't touch the ground plane conductive material.

In an embodiment, a fourth dielectric article of manufacture 1660 includes hybrid technology circuits for polarization or beam steering or both within conductive walls of their own. Signal carriers 1661 1662 are shown at their upper surfaces aligned with the signal carrying conductive material 1651, 1652 of the second ground plane surface. Antenna patch polarization can be circular, elliptical or linear.

Figure 17:
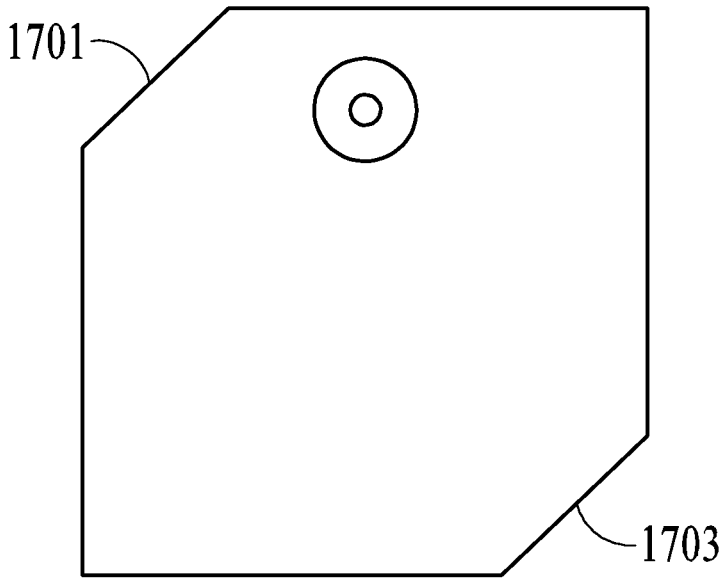
FIG. 17-18 are top views of polarized antenna patches, conductive wall, and probes. It is understood that the probes, conductive walls, ground planes, and hybrid circuits are embedded within layers of conventional dielectric substrate. The figures in some cases require presentation of the substrate as transparent to facilitate understanding of the invention.
Figure 18:
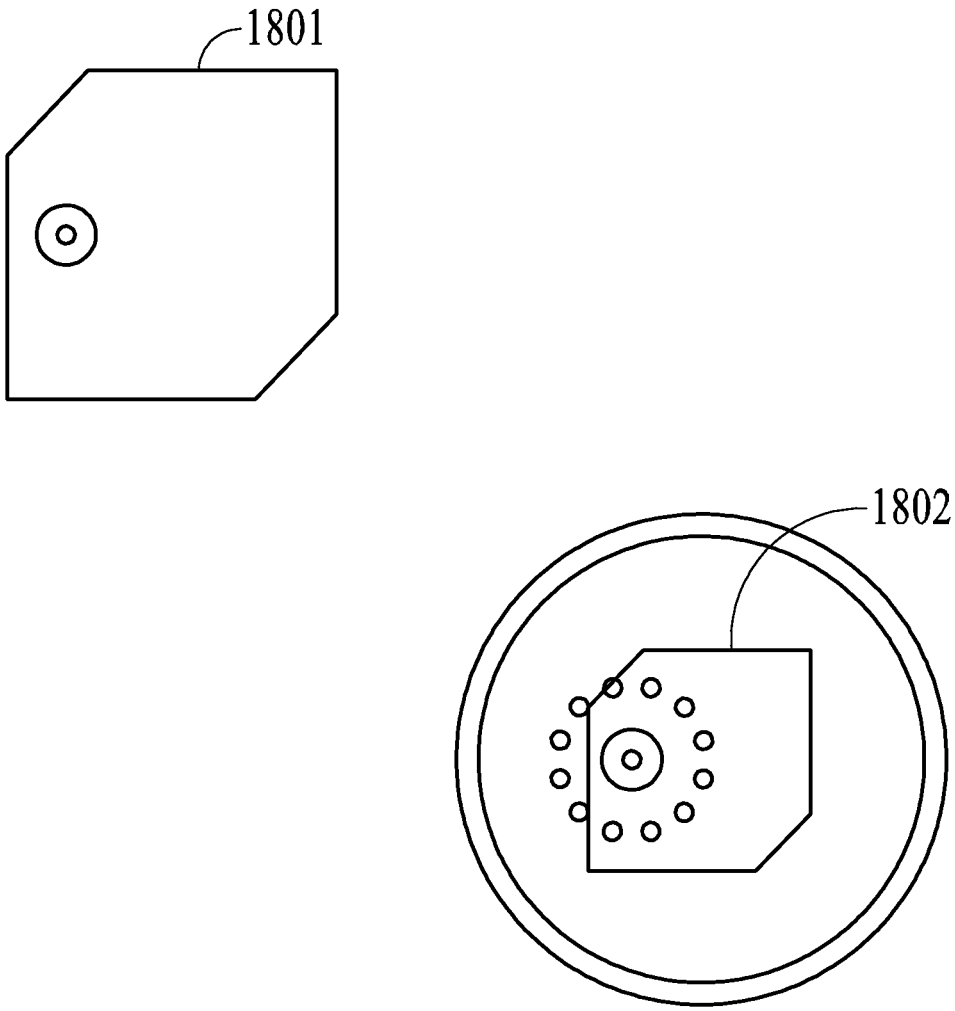

In an embodiment, a single feed generates circular polarization without requiring hybrid topology by chamfered corners of a square patch. In other words, a four sided square patch may be realized as a six sided lozenge by chamfering opposite corners 1701 1702 as illustrated in FIG. 17. This results in circular polarization. A top view of single circular polarized receive 1801 and transmit 1802 elements using chamfered corners is illustrated in FIG. 18.

Figure 19:
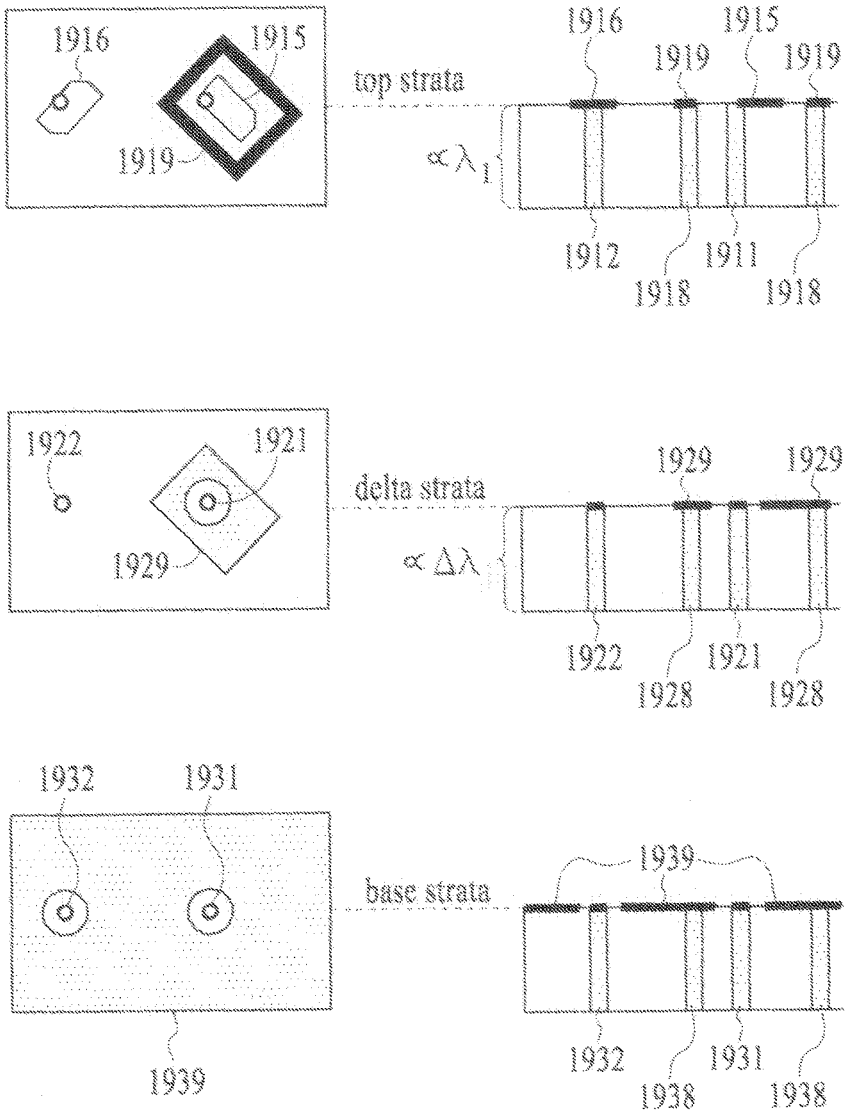
FIG. 19-20 are top and sectioned views of three strata embodiments.

Referring now to FIG. 19, in an embodiment of the invention, an exemplary top strata is of a thickness proportional to the wavelength of a first signal (cx lambda subscript 1). The top strata has a conductive wall 1919 on its upper surface to isolate electromagnetic fields of the first signal from electromagnetic fields of a second signal. In an embodiment, the conductive wall forms a polygon. As is known, a parallelogram is a specialized type of polygon and a square is a type of parallelogram. At least one signal carrier 1911 propagates the first signal to a first polarized patch antenna 1915 enclosed by the conductive wall 1919. At least one signal carrier 1912 propagates the second signal to or from a second polarized patch antenna 1916. A plurality of ground carriers 1918 extends the conductive wall to a ground plane. In an embodiment each polarized patch antenna may receive a plurality of phases of its respective signal.

An exemplary delta strata is of thickness proportional to the difference between a first wavelength of the first signal and a second wavelength of the second signal (cx delta lambda). The delta strata has a conductive layer on its upper surface forming a 1st ground plane 1929. In an embodiment the 1st ground plane is an area bounded by a polygon with at least one opening. As is known, a square, rectangle, and parallelogram are types of polygons. Each first signal 1921 passes through an opening within ground plane 1929. Each second signal 1922 is isolated from the first signal 1921 by a plurality of ground carriers 1928.

An exemplary base strata has a conductive layer on its upper surface forming a second ground plane 1939 in which there are a plurality of openings. In an embodiment signal carriers 1931 and 1932 pass through these openings for first signal and second signal. In another embodiment (not shown) additional phases of first signal and second signal pass through to provide polarized signals. A plurality of ground carriers 1938 connects the second ground plane to first and second signal grounds.

Figure 20:
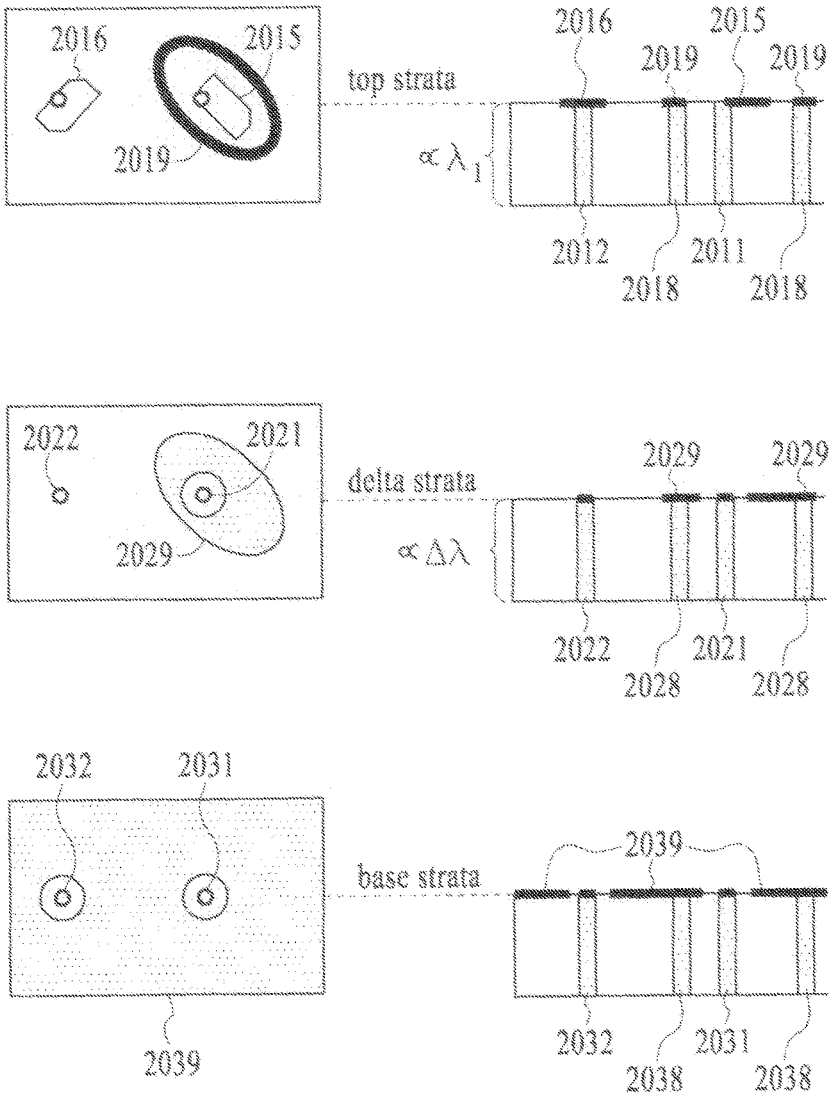

Referring now to FIG. 20, in an embodiment of the invention, an exemplary top strata is of a thickness proportional to the wavelength of a first signal (cx lambda subscript 1). The top strata has a conductive wall 2019 on its upper surface to isolate electromagnetic fields of the first signal from electromagnetic fields of a second signal. In an embodiment, the conductive wall forms an ellipse. As is known, a circle is a specialized type of ellipse. At least one signal carrier 2011 propagates the first signal to a first polarized patch antenna 2015 enclosed by the conductive wall 2019. At least one signal carrier 2012 propagates the second signal to or from a second polarized patch antenna 2016. A plurality of ground carriers 2018 extends the conductive wall to a ground plane. In an embodiment each polarized patch antenna may receive a plurality of phases of its respective signal.

An exemplary delta strata is of thickness proportional to the difference between a first wavelength of the first signal and a second wavelength of the second signal (cx delta lambda). The delta strata has a conductive layer on its upper surface forming a 1st ground plane 2029. In an embodiment the 1st ground plane is an area bounded by an ellipse with at least one opening. As is known, a circle is a specialized type of ellipse. Each first signal 2021 passes through an opening within ground plane 2029. Each second signal 2022 is isolated from the first signal 2021 by a plurality of ground carriers 2028.

An exemplary base strata has a conductive layer on its upper surface forming a second ground plane 2039 in which there are a plurality of openings. In an embodiment signal carriers 2031 and 2032 pass through these openings for first signal and second signal. In another embodiment additional phases of first signal and second signal pass through to provide polarized signals. A plurality of ground carriers 2038 connects the second ground plane to first and second signal grounds.

In another embodiment a checkerboard pattern of metal walls and elevated grounds makes the dual frequency circular polarized element pattern smooth.

One aspect of the invention is an article of manufacture for directed beam electromagnetic (EM) telecommunications. The article includes layers of dielectric substrate; infused by, multiple first antenna patches; a first ground plane having at least one opening beneath each first antenna patch; first electromagnetic (EM) signal carrier via (probe) electrically coupled to each first antenna patch and passing through the opening of the first ground plane; a conductive wall (e.g. can be approximated by a plurality of conductive vias) proportional in height to an intended operating wavelength of each first antenna patch electrically coupled to the first ground plane beneath each first antenna patch; multiple second antenna patches; a second ground plane having at least one opening beneath each second antenna patch; and, a second EM signal carrier via (probe) electrically coupled to each second antenna patch and passing through the opening of the second ground plane.

Each patch can be independently polarized.

In an embodiment, polarization is circular.

In an embodiment, polarization is elliptical.

Circular or elliptical polarization can be accomplished by multiple probe signals or by shaping the antenna patch. Chamfering opposing corners would accomplish such a polarization.

In an embodiment, each first and second ground plane is separated from its respective antenna patch by a depth of dielectric material proportional to the wavelength of its intended operating frequency in the dielectric material.

In an embodiment, EM includes microwaves.

In an embodiment, EM includes radio waves.

In an embodiment, the apparatus also includes: a conductive wall (can be realized by a plurality of conductive vias) coaxially positioned with each EM probe of the first patch and electromagnetically coupled with the EM probe as a transmission line. The arrangement of the plurality of first antenna patches and the plurality of second antenna patches can be visualized as a checkerboard with first antenna patches as light and second antenna patches as dark.

In an embodiment, the apparatus also includes: a first hybrid circuit coupled to at least one first antenna patch; a second hybrid circuit coupled to at least one second antenna patch; a conductive wall (which can be realized with a plurality of conductive vias) surrounding each hybrid circuit, said wall coupled to a ground plane above the hybrid circuit and to a ground plane below the hybrid circuit, whereby the first hybrid circuit is electromagnetically isolated from the second hybrid circuit; and, wherein each said hybrid circuits is coupled to one antenna patch by at least one EM probe, each probe of the first patch is coaxially shielded beneath the first ground plane by a conductive wall electrically coupled with the EM probe as a transmission line. Each probe of the second patch is directly coupled to the second hybrid.

CONCLUSION

Thus it can be appreciated that the invention is easily distinguished from conventional directed beam antenna systems by its frequency diversity. Each quadrature hybrid is isolated by ground planes coupled to a conductive wall. A first antenna patch operating at a first frequency is isolated from a second antenna patch operating at a second frequency by a conductive wall (realized by a plurality of conductive vias) coupled to a first ground plane. A second ground plane is provided to optimize the performance of the second antenna patch at the second frequency. Each signal probe energizing the first antenna patch is further shielded by a conductive wall of coaxial shape between the first and second ground plane.

A number of embodiments of the invention have been described. Nevertheless, it will be understood that various modifications may be made without departing from the spirit and scope of the invention. Accordingly, other embodiments are within the scope of the following claims.

I claim:

1. A phased-array planar antenna (antenna) comprises:

a plurality of dielectric strata infused by, a plurality of ground planes to optimize operation at more than one frequency;

a plurality of phased-array elements isolated by conductive walls in a multi-layer substrate;

orthogonally polarized antenna patches to improve signal discrimination;

a top strata of a thickness proportional to the wavelength of a first signal, said top strata having a conductive wall on its upper surface to isolate electromagnetic fields of the first signal from electromagnetic fields of a second signal, the conductive wall forming a polygon, at least one signal carrier to propagate the first signal to a first polarized patch antenna enclosed by the conductive wall, at least one signal carrier to propagate the second signal to a second polarized patch antenna, a plurality of ground carriers to extend the conductive wall to a ground plane;

a delta strata of thickness proportional to the difference between a first wavelength of the first signal and a second wavelength of the second signal, said delta strata having a conductive layer on its upper surface forming a 1st ground plane, the 1st ground plane forming an area bounded by a polygon with at least one opening, each first signal passing through an opening within ground plane, each second signal isolated from the first signal by a plurality of ground carriers; and a base strata having a conductive layer on its upper surface forming a second ground plane in which there are a plurality of openings, signal carriers passing through these openings for first signal and second signal, a plurality of ground carriers connecting the second ground plane to first and second signal grounds.

2. A phased-array planar antenna (antenna) comprises:

a plurality of dielectric strata infused by, a plurality of ground planes to optimize operation at more than one frequency;

a plurality of phased-array elements isolated by conductive walls in a multi-layer substrate;

orthogonally polarized antenna patches to improve signal discrimination;

a top strata of a thickness proportional to the wavelength of a first signal, said top strata having a conductive wall on its upper surface to isolate electromagnetic fields of the first signal from electromagnetic fields of a second signal, said conductive wall forming an ellipse, at least one signal carrier to propagate the first signal to a first polarized patch antenna enclosed by the conductive wall, at least one signal carrier to propagate the second signal to a second polarized patch antenna, a plurality of ground carriers to extend the conductive wall to a ground plane;

a delta strata of thickness proportional to the difference between a first wavelength of the first signal and a second wavelength of the second signal, said delta strata having a conductive layer on its upper surface forming a 1st ground plane, said 1st ground plane forming an area bounded by an ellipse with at least one opening, each first signal passing through an opening within said ground plane, each second signal isolated from the first signal by a plurality of ground carriers; and a base strata having a conductive layer on its upper surface forming a second ground plane in which there are a plurality of openings, signal carriers passing through these openings for first signal and second signal, a plurality of ground carriers connecting the second ground plane to first and second signal grounds.

* * * * *